United States Patent [19]

Zodrow et al.

[11] 4,292,117

[45] Sep. 29, 1981

[54] GLUE ROLLER IN A LABELING MACHINE

[75] Inventors: Rudolf Zodrow, Dusseldorf; Egon Höveler, Haan, both of Fed. Rep. of Germany

[73] Assignee: Jagenberg Werke AG, Fed. Rep. of Germany

[21] Appl. No.: 49,714

[22] Filed: Jun. 18, 1979

[30] Foreign Application Priority Data

Jun. 19, 1978 [DE] Fed. Rep. of Germany ..... 2826618

[51] Int. Cl.[3] ..... B05C 1/08; B65C 9/16

[52] U.S. Cl. ..... 156/578; 29/123; 118/244; 118/258; 156/571; 156/DIG. 32

[58] Field of Search ..... 156/568, 571, 578, DIG. 32; 118/244, 258, 231; 29/123, 116 R

[56] References Cited

U.S. PATENT DOCUMENTS 1,942,383 1/1934 Dickhaut et al. ..... 118/258

3,500,524 3/1970 Jagminas ..... 118/244

3,549,459 12/1970 Whitecar ..... 156/568

3,763,823 10/1973 Nilsson ..... 118/258

*Primary Examiner*—Michael G. Wityshyn

*Attorney, Agent, or Firm*—Sprung, Felfe, Horn, Lynch & Kramer

[57] ABSTRACT

A glue roller assembly for use in a labeling machine includes a drive shaft mounted rotatably in the machine frame and coupled with the machine drive by a transmission. A glue roller barrel is adjustable relative to the glue segments of the labeling machine and is mounted to permit radial adjustment thereof via a hollow shaft disposed substantially concentrically around the drive shaft of the glue roller and fixed to the machine frame. The barrel is coupled to the hollow shaft to permit the radial adjustment of the glue roller barrel with respect thereto and the glue roller barrel is coupled to the drive shaft in the circumferential direction.

4 Claims, 3 Drawing Figures

GLUE ROLLER IN A LABELING MACHINE

BACKGROUND OF THE INVENTION

The invention relates to a glue roller in a labeling machine, whose central drive shaft rotatably mounted in the machine frame is coupled with the machine drive through a transmission, especially a gear transmission, and whose periphery is adjustable relative to the glue segments of the labeling machine.

To assume the faultless application of glue to the glue segments by the glue roller, it is necessary that the glue segments roll with their entire glue-bearing surface against the glue roller, the distance between the glue roller and the glue-bearing surface remaining constant with the greatest possible accuracy. To satisfy this requirement the glue roller must be aligned with the glue segments.

In a known glue roller of the kind mentioned above, the barrel of the glue roller is mounted directly on the drive shaft. Any necessary adjustment is performed with the drive shaft. The fact that the dynamic coupling between the drive shaft and the machine is not optimum in every case when such adjustments are made is tolerated. In the case of low machine capacities, the less than perfect meshing of the gears of the drive is tolerated. However, in the case of high capacities of 50,000 label applications per hour, such as are often used today, these irregularities are no longer acceptable since the gear train would wear too quickly.

SUMMARY OF THE INVENTION

It is the object of the invention to create a glue roller of the kind described above, whose use will not lead to premature wear of the transmission even at the highest machine outputs, and in which adjustment with respect to an adjustment made in the transmission is simplified.

This object is achieved in accordance with the invention by disposing the barrel of the roller on a hollow shaft concentric with the drive shaft, permitting a radial shifting of the roller barrel with respect to the hollow shaft, and by providing a positive rotational drive coupling between the drive shaft and the roller barrel.

In the glue roller of the invention, the gear drive or countershaft of the glue roller remains unaffected by the adjustment, so that optimum meshing of the gears is preserved. Accordingly, premature wear of the transmission cannot occur. The adjustment can be accomplished simply and quickly, since it is performed on two axially separate bearings.

One simple method of adjusting the bearings with respect to the hollow shaft consists of using clamping screws inserted with clearance into bores in flanges of the hollow shaft for the purpose of fastening the bearings on the hollow shaft.

In order to provide support for the roller barrel over its entire circumference without producing strain when adjustments are made, the roller barrel can be held on spherically shaped outside surfaces of the outer rings of the bearings.

Preferably, the coupling between the drive shaft and the roller barrel is in the form of a plate fastened on the end of the drive shaft, having on its circumference a radial lobe which engages a recess in the roller barrel. In this manner it is brought about by simple means that no jamming takes place when the roller barrel and drive shaft are not concentric with one another.

BRIEF DESCRIPTION OF THE DRAWINGS

The invention will now be explained further with the aid of a drawing, wherein.

DETAILED DESCRIPTION OF THE INVENTION

Figure 1:
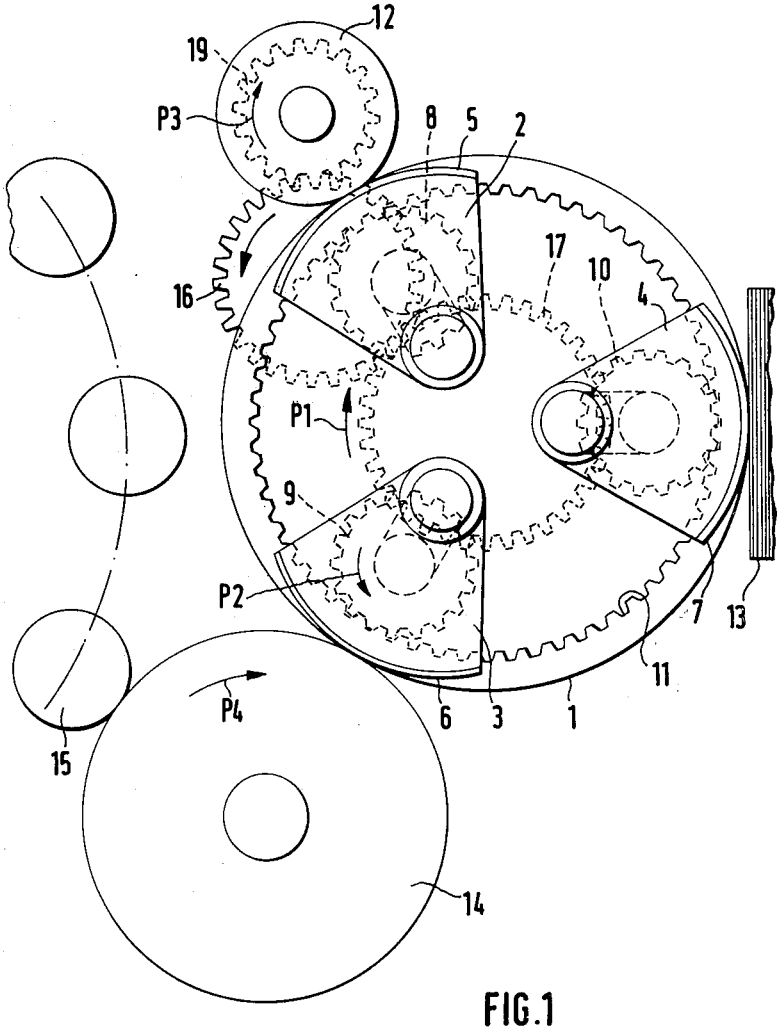
FIG. 1 is a diagrammatic plan view of a labeling machine.

The labeling machine represented in FIG. 1 consists of a plate-like carrier 1 rotating in the direction of the arrow $P_1$, on which three glue segments 2, 3 and 4 are rotatably mounted between their cylindrically curved pickup surfaces 5, 6 and 7, respectively, and their center of curvature. These glue segments 2, 3 and 4 are driven by meshing with a stationary sun gear 11 by means of their pinions 8, 9 and 10, respectively, which serve as planetary gears. When the carrier 1 revolves in the direction of the arrow $P_1$, therefore, the glue segments 2, 3 and 4 rotate in the direction of the arrow $P_2$.

Outside of a circle described by the pickup surfaces 5, 6 and 7 of the glue segments 2, 3 and 4, there are provided a glue roller 12 rotating in the direction of the arrow $P_3$, a stationary label box 13 presenting the labels flatly to the glue segments, and a gripper cylinder 14 rotating in the direction of the arrow $P_4$. The glue roller 12 and the gripper cylinder 14 are driven by the carrier 1 through gears. The objects being labeled, which in the present case are the standing bottles 15, are moved past the gripper cylinder 14 on an arcuate path.

The operation of such a labeling machine is as follows: The glue segments 2, 3 and 4 roll at the individual stations against the glue roller 12, the front face of the stock of labels contained in the label box 13, and the gripper cylinder 14, the pickup surfaces 5, 6 and 7 being coated with glue by the glue roller 12. The pickup surfaces are able, by their stickiness, to pick the foremost label up from the label box and transport it to the gripper cylinder 14, which peels it away from the pickup surfaces 5, 6 or 7 and presses it against the object being labeled.

Such a labeling machine is known in the art as evidenced by U.S. Pat. No. 3,928,120.

Figure 3:
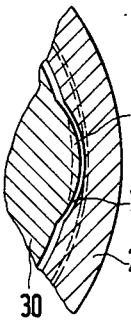
FIG. 3 is a cross-sectional view taken along line A—A of FIG. 2.
Figure 2:
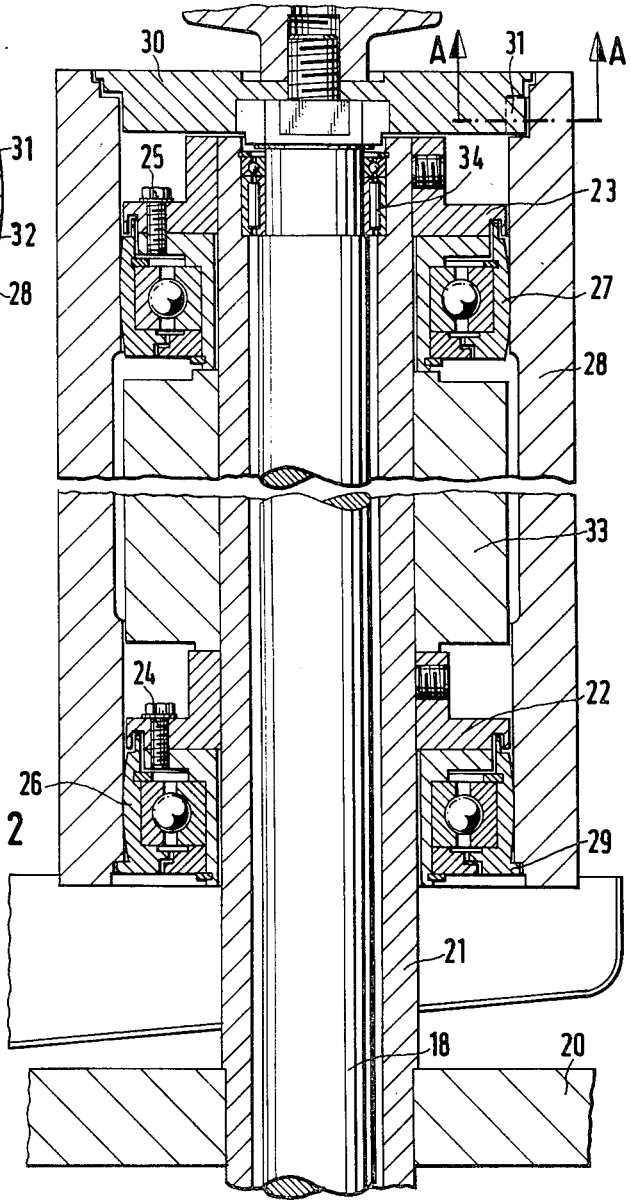
FIG. 2 is an axial cross sectional view taken through a glue roller.

In such a labeling machine it is also known to couple the glue roller 12 by means of a gear train consisting of a plurality of gears to a gear 17 rotating with the carrier 1. In contrast to the state of the art set forth in the background however, in the case of the invention the drive shaft 18 is mounted fixedly in the machine frame 20 as is shown in FIGS. 2 and 3. As a result, optimum meshing of the gears 17, 16 and 19 is possible. In the machine frame 20, a hollow shaft 21 is furthermore disposed in a stationary and nonrotating manner concentrically with the drive shaft 18. The hollow shaft 21 bears two axially separate flanges 22 and 23, to which bearings 26 and 27, respectively, are fastened by means of bolts 24 and 25 which are passed through bores with clearance. The bearings 26 and 27 bear on their outer sides, which are spherically rounded, the barrel of the glue roller 28. This glue roller is supported at its bottom edge on a step 29 of the bearing 26, on which it rests exclusively by its own weight. This suffices to keep it in place axially. It is not held at its upper edge. A plate 30, which is threaded onto the end of shaft 18, has a radial lobe 31 engaged in a recess 32 in the barrel of the glue roller 28. Otherwise there is clearance between the plate 30 and the barrel of the glue roller 28. This positive drive coupling between the plate 30 and the glue roller barrel 28 is what enables the glue roller barrel 28 to be driven by the shaft 18. On account of the clearance remaining, the glue roller barrel 28 is able to rotate even when the drive shaft 18 is not disposed concentrically with the hollow shaft 21.

As an aid in assembly, a sleeve 33 is provided between the flange 22 and the bearing 27, which helps to align the glue roller barrel 28 as it is being installed. To keep the drive shaft 18 and the hollow shaft 21 concentric with one another, a bearing 34 is provided at the end of the shaft 18 between the shaft 18 and hollow shaft 21.

The barrel of the glue roller 28 can be adjusted both parallelly and angularly with respect to the drive shaft 18 and the hollow shaft 21 by the radial displacement of one or both of the two bearings 26 and 27. This can be done within a range of several one-hundredths of a millimeter.

It will be appreciated that the instant specification and example are set forth by way of illustration and not limitation, and that various modifications and changes may be made without departing from the spirit and scope of the present invention.

What is claimed is:

1. In a glue roller assembly for use in labeling machine having glue segments, the assembly having a stationary machine frame, a roller drive shaft mounted rotatably in the machine frame coupled with a machine drive by a transmission and a glue roller barrel which is adjustable relative to the glue segments of the labeling machine, the improvement comprising means mounting the glue roller barrel to permit radial adjustment thereof relative to the drive shaft comprising a stationary hollow shaft disposed substantially concentrically around the drive shaft and fixed to the machine frame, axially offset bearing means disposed between the barrel and the hollow shaft to permit the radial adjustment of the glue roller barrel with respect to the hollow shaft and means for coupling the drive shaft and the glue roller barrel to prevent relative movement in the circumferential direction while permitting radial adjustment.

2. The glue roller assembly of claim 1, wherein the hollow shaft has flanges with bores therein and the bearing means include bolts for fastening the bearing means to the hollow shaft and which are receivable in the bores with a clearance to effect radial adjustment.

3. The glue roller assembly of claim 1 wherein the bearing means comprises a spherical outer ring on which the roller barrel is borne.

4. The glue roller assembly of claim 1 wherein the coupling of the drive shaft and the glue roller barrel comprises an annular recess in the inner surface of the glue roller barrel and a plate fastened to one end of the drive shaft having a radial lobe on the periphery which engages the annular recess in the glue roller barrel.

* * * * *